United States Patent [19]

Natsuhara et al.

[11] Patent Number: 4,987,454

[45] Date of Patent: Jan. 22, 1991

[54] DEVELOPING METHOD FOR DEVELOPING ELECTROSTATIC LATENT IMAGE

[75] Inventors: Toshiya Natsuhara; Yuji Enoguchi; Hiroshi Mizuno; Masahiro Anno; Junji Machida, all of Osaka, Japan

[73] Assignee: Minolta Camera Kabushiki Kaisha, Osaka, Japan

[21] Appl. No.: 367,121

[22] Filed: Jun. 16, 1989

[30] Foreign Application Priority Data

Jun. 17, 1988 [JP] Japan ..... 63-150801

[51] Int. Cl.[5] ..... G03G 15/06

[52] U.S. Cl. ..... 355/259; 430/109; 430/111

[58] Field of Search ..... 430/109, 111, 138; 355/259, 246, 251, 253, 245; 118/653, 656, 657, 658

[56] References Cited

U.S. PATENT DOCUMENTS

| | | | |
|---|---|---|---|
| 4,100,884 | 7/1978 | Mochizuki et al. . | |
| 4,284,701 | 8/1981 | Abbott et al. . | |
| 4,601,967 | 7/1986 | Suzuki et al. . | |
| 4,758,506 | 7/1988 | Lok et al. | 430/111 X |
| 4,791,882 | 12/1988 | Enoguchi et al. | 355/259 X |
| 4,810,612 | 3/1989 | Ueda et al. | 430/109 |
| 4,816,365 | 3/1989 | Ishikawa | 430/111 |
| 4,835,082 | 5/1989 | Koishi et al. | 430/109 |

FOREIGN PATENT DOCUMENTS 62-103675 5/1987 Japan .

*Primary Examiner*—A. T. Grimley
*Assistant Examiner*—Thu A. Dang
*Attorney, Agent, or Firm*—Burns, Doane, Swecker & Mathis

[57] ABSTRACT

In a method for developing an electrostatic latent image comprising the steps of;

(a) supplying toner onto a toner transporting member which confronts an electrostatic latent image support member with the leectrostatic latent image thereon at an developing region, said toner being 12 μm or less in mean particle size, 10% or less of toner with at least 16 μm in particle size, and 20% or less in coefficient of variation;

(b) forming a thin layer of said toner on the toner transporting member by pressing said toner; and (c) transferring said toner from said thin layer of said toner onto the electrostatic latent image formed on an electrostatic latent image support member for developing the electrostatic latent image.

19 Claims, 2 Drawing Sheets

DEVELOPING METHOD FOR DEVELOPING ELECTROSTATIC LATENT IMAGE

BACKGROUND OF THE INVENTION

This invention relates to a developing method of electrostatic latent images formed on a surface of electrostatic latent image carrier with charged toner in an uniformly thin layer formed on a toner transporting member.

Electrostatic latent images are formed, first, on a surface of a photosensitive member in the electrophotographic formation of copied images. Then, the electrostatic latent images on the surface of the photosensitive member are provided with charged toner by a developing device to develop the electrostatic latent images (or make the electrostatic latent images visible). The resultant toner images are transferred and fixed onto a copying member such as copying paper.

In a developing method of electrostatic latent images as above mentioned, in particular, in an one-component developing method using non-magnetic toner, it is important to provide a surface of a photosensitive member with charged toner in an uniformly thin layer.

In a conventional one-component developing method as disclosed, for example, in Japanese Patent Laid Open No. 143831/1977, a surface of elastic developing roller are provided with non-magnetic toner, the non-magnetic toner is pressed against the roller by a blade to charge the toner and form a thin layer of charged toner around the outersurface of the roller, and toner images are formed by contacting directly the charged toner in a thin layer with a surface of photosensitive member.

In a conventional method as above mentioned, the smaller the particle sizes of toner are, the easier the toner are selected and consumed (referred to as "particle size selecting phenomenon" hereinafter), resulted in a change of distribution of particle sizes of toner. Consequently, when toner are used for a long time, image qualities change (deteriorate).

SUMMARY OF THE INVENTION

The object of the invention is to solve the particle size selecting problem as above mentioned and provide a developing method for the formation of excellent copied images without fogs in images and flied toner around characters.

Another object of the invention is to provide a developing method for the formation of clear and sharp copied images stable in qualities for a long time.

DETAILED DESCRIPTION OF THE INVENTION

Figure 1:
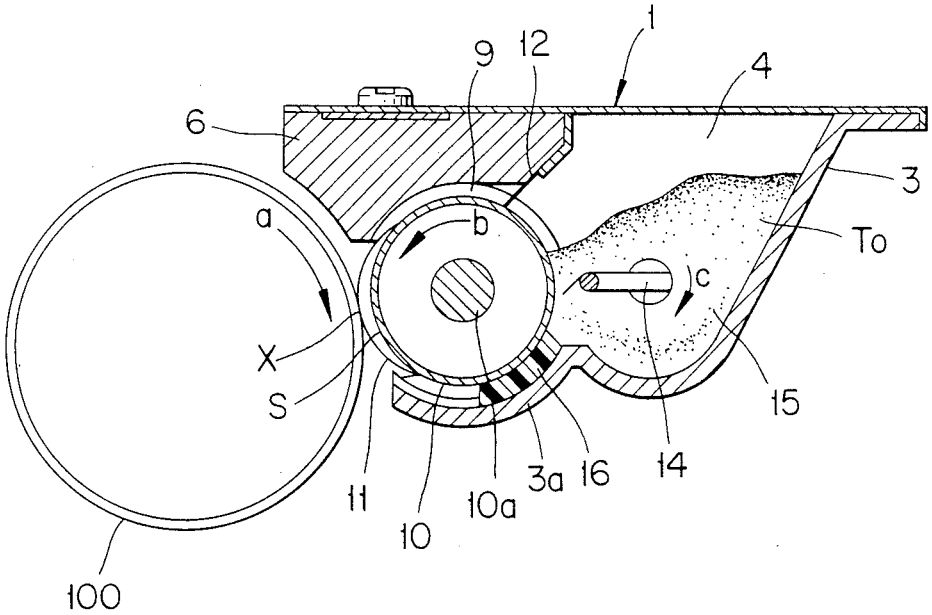
FIG. 1 is a cross-sectional view of a developing device.

The present invention relates to a developing methods of an electrostatic latent image comprising;

(a) supplying toner onto a toner transporting member which confronts an electrostatic latent image support member with the electrostatic latent image support member with the electrostatic latent image thereon at a developing region, said toner being 12 μm or less in mean particle size, 10% or less of toner with at least 16 μm in particle size, and 20% or less in coefficient of variation;

(b) forming a thin layer of said toner on the toner transporting member by pressing said toner; and (c) transferring said toner from said thin layer of said toner onto the electrostatic latent image formed on an electrostatic latent image support member for developing the electrostatic latent image.

Mean particle size of toner used in a developing method of the present invention is 12 μm or less. If it is more than 12 μm, fogs and roughness in image quality are generated unpreferably. The ratio of toner with at least 16 μm is 10% by weight or less on the basis of weight of all toner. If the ratio is more than 10%, fogs in copied images and toner flying around characters are generated.

Particle size-selecting phenomenon is thought to be observed as below; first of all, toner which can pass more easily through toner levelling position are consumed selectively because a toner levelling member is contacted with or close to a toner transporting member. It is generally known that toner with big particle sizes show smaller charge amount in unit weight than toner with small particle sizes, because toner with big particle sizes have smaller surface area in unit weight than toner with small particle sizes and the small possibility of contact of toner with a frictional static member makes charge amount of toner low.

In non-magnetic one-component developing method, because a layer of charged toner is maintained on a toner supporting member by its image-force (the image-force means the electrically attracting force of toner to the toner supporting member, and vice versa), the degree of the image-force directly influences passing properties of toner through levelling position. Accordingly, as toner with small particle size which are attracted strongly to a toner supporting member first pass through a toner levelling position selectively, the ratio of toner with big particle size increases gradually. Charge amount in unit gram of toner decreases, resulting in the unpreferable generation of fogs in copied images and toner flying around copied characters.

In particular, if toner of 16 μm or more in particle size are contained at more than 16% by weight, those big toner acts as "bad toner" in a developing process. Consequently, it is necessary that toner of 16 μm or more in particle size are contained at 10% or less in the present invention.

Particle size selecting phenomenon aforementioned is observed remarkably in a developing machine adjusting toner levelling member at low pressure. In general, as a developing device of small type are drived at low torque, a toner levelling member is controlled preferably at low pressure. However, as the toner levelling member controlled at low pressure is pressed weakly against toner in the developing machine, the distribution of toner charge amount is broadened, resulting in easy generation of particle size selecting phenomenon that toner with small particle size are charged at high level to be more liable to be consumed at development than toner with big particle size.

A developing device with a toner levelling member controlled at low pressure is exemplified by the one as shown in FIG. 1 equipped with toner transporting member wherein a outer sleeve member (11) (a cylindrical member of thin layer) is mounted around a driving roller (10). In such a developing machine, the outer sleeve member (11) is drived by its frictional force against the driving roller (10).

The strong pressure of the toner levelling member (12) controlling the toner layer thickness would prevent the outer sleeve member (11) from being driven to cause the slip of the outer sleeve member (11) along over the driving roller (10). Consequently, a developing machine as shown in FIG. 1 is equipped with the toner levelling member (11) controlled at low pressure. Therefore, desired toner used in the developing machine as shown in FIG. 1 have 20% or less in coefficient of variation, preferably 10% or less in order to prevent particle size selecting phenomenon and form an uniform thin layer of toner.

Coefficient of variation in the present invention means variation measures (%) obtained as follows; a photograph is taken with a scanning electron microscope, one hundred of particles are taken at random for measurement of particle sizes to obtain a standard deviation value ($\rho$), the standard deviation value ($\rho$) is divided by the mean particle size (X), and one hundred times the divided value is the coefficient of variation (%).

The standard deviation value is represented by the square root of the total values of the square of the difference between the mean particle size and each particle size represented by the following formula;

$$\sigma = \sqrt{\frac{(X_1 - X)^2 + (X_2 - X)^2 + (Xn - X)^2}{N - 1}} \approx \sqrt{\frac{1}{n-1}\left[\Sigma X_i^2 - \frac{(\Sigma X_i)^2}{n}\right]}$$

Wherein $X_1$, $X_2$ ---, $X_n$ represent respective particle sizes of sample particles, X represents the mean value of the n particle sizes.

If the coefficient of variation exceeds 20%, toner are consumed in the order from small ones to big ones on the basis of toner distribution condition in development process.

Such phenomenon aforementioned causes the change of image quality such as roughness in copied image quality, deterioration of resolving power after used for a long time and the lack of reproducibility of initial copied image quality. If desired, copied image qualities are further improved when the coefficient of variation is 10% or less. Toner of 10% or less in the coefficient of variation have high fluidity and effect the formation of toner thin layer excellent in uniformity on a toner support member after passing through the toner levelling position, long time stability of copied image quality, and the formation of very clear copied images.

Preferable toner for the present invention are spherical. Spherical toner mean that SF1 is 100–130 and SF2 is 100–140; in which SF1 and SF2 are each one of shape coefficients, SF1 is defined as $$SF1 = \frac{(\text{maximum length})^2}{(\text{area})} \times \frac{\pi}{4} \times 100$$

and shape coefficient SF2 is defined as $$SF2 = \frac{(\text{circumference length})^2}{(\text{area})} \times \frac{1}{4\pi} \times 100$$

wherein area is a mean value of projected area of particles; maximum length is a mean value of maximum lengths of projected images of particles; circumference length is a mean value of circumference lengths of projected images of particles.

In more detail, these shape coefficient are used to express forms and/or shapes of particles, and SF1 expresses the difference between long diameter and short diameter (distortion properties), and SF2 expresses irregularities of surfaces of toner particles.

If particles are completely spherical, both SF1 and SF2 are 100.

The shape coefficients may be measured by Image Analyzer (LUZEX 5000; made by Nihon Regulator).

Spherical toner have small rolling coefficients of friction because of those spherical shapes, and pass very easily through toner levelling position in a developing machine. Therefore, spherical toner are most preferable for a developing machine driven at low torque.

Toner used in the present invention are, however, not limited to spherical toner but may be undefined-shape toner so far as they meet conditions as above mentioned.

Undefined-shape toner may be prepared by mixing, fusing and kneading thermoplastic resin together with pigments such as carbon black and the like to disperse the pigments in the resin and then resultant mixture are ground to particles with desired particle size in a grinder.

Spherical toner may be prepared by wet granulation methods such as a suspension method, a suspension polymerization method, an encapsulization method, a spray-dry method and the like, by spherization methods of usual unfixed-shape toner by a heat treatment, a mechanical treatment giving shearing force to particle surfaces, by encapsulating methods in dry conditions, and the like.

Spherical toner may be prepared by suspension method in which various kind of polymers and/or prepolymers obtained beforehand are dissolved and/or dispersed in organic solvent and/or monomers together with other toner components such as pigments and the like, and the resultant solution is dispersed in an aqueous medium in the presence of surfactants followed by mixing, stirring and granulating.

Spherical toner may be also prepared by suspension polymerization in which monomers, polymerization initiators, pigments, charge controlling agents are mixed and the resultant mixture is suspended in an aqueous medium followed by polymerization.

Laminated toner are preferably used in the present invention in which one or more layers containing at least one toner components such as colorant, resins, charge controlling agents, magnetic powders and the like are formed on the surfaces of core particles comprising mainly thermoplastic resin prepared by a suspension method, a suspension polymerization method, an emulsion polymerization method, seed polymerization and the like.

In particular, core particles prepared by a seed polymerization method are preferable in the present invention because the core particles are spherical and have sharp distribution of particle sizes, that is, very small degree of variability.

More preferable toner comprises core particles and positive or negative charge controlling agents fixed on the surfaces of core particules. Those toner are prepared by adhering the charge controlling agents on the surfaces of core particles and fixing them thereon by partially heating the surfaces or partially increasing the surface temperature by applying mechanical impact forces thereto or by dissolving or swelling only the surfaces with a little organic solvent.

If spherical toner prepared by various kinds of methods as above mentioned have broad distribution of particle sizes, stable frictional charging properties are not achieved resulting in the formation of fogs on copying substance and unstability of charge amount at continuous developments. Therefore, sharp distribution of toner particles are needed.

Some kinds of most preferable toner used in the present invention comprises spherical polymer particles with very sharp distribution of particle sizes prepared by a seed polymerization method to have mean particle size of 1–15 μm, preferable 2–10 μm, and at least one layer on the surfaces of polymer particles comprising toner components such as colorants, resins, magnetic particles, charge controlling agents and the like, and the charge controlling agents cropping out from the surfaces of the polymer particles. Such toner are practically spherical, have small degree of variability and effect effectively the improvement of frictional chargeability and fogs on a copying substance caused by flying toner, particularly in a contact-type developing method. Any conventional toner components per se known may be applied to thermoplastic resins, colorants and the like for the production of toner (unfixed shape toner and spherical toner prepared by a suspension method, a encapsulating method, a spray drying method and the like).

Thermoplastic resins are exemplified by polyolefins such as polystyrene, styrene-acrylic copolymer, polyester, epoxy resin, polyethylene, polypropylene and the like, polyamide resin, polyurethane resin, maleic acid resin, modified resin thereof and the like. Any of those resins may be used singly or in combination with other resin.

Seed polymerization are carried out as follows; An aqueous dispersion with lipophilic polymerization initiators or a solution thereof finely dispersed at 0.1–1 μm or less in particle size is added to a latex containing polymer particles of 0.1–1 μm with narrow particle size distribution so that the polymer particles may absorb the lipophilic polymerization initiators or the solution thereof. Then, one or more monomers, the polymers of which have 50°–100° C. in glass transition temperature, are added to the resultant solution to polymerize them in the presence of suspension stabilizers such as polyvinyl alcohol, methyl cellulose, CMC, polyvinyl pyrrolidone and the like at 40°–90° C. in stirring conditions. When resultant polymer particles do not have desired sizes, the above mentioned processes may be repeated to make particle sizes big to the desired extent. Metal oxides such as tin oxide, magnetite and the like may be contained in the polymer particles. Further, the polymer particles may be encapsulated by mechanical coating of polymer or a mixture of polymer and pigments, or by a mixture of polymer and pigments, or by in situ polymerization so far as particle size distribution does not change so much. In other embodyment, a layer containing pigments is formed on the polymer particles, on which a resin layer may be formed. Further charge controlling agents are applied to the resin layer to improve chargeability.

In detail treatment, core particles are mixed mechanically with fine particles for treatment or coating at an adequate ratio to adhere the fine particles uniformly around the core particles taking advantage of van der Waals attraction or electrostatic force, and then the fine particles and/or the surfaces of core particles are partially heated and softened for layer formation. Such a machines as used in the method aforementioned are exemplified by Hybridization System (applied by impact method in high speed gass flow) (made by Nara Kikai Seisakusho K. K.), Angmill (Hosokawa Micron K. K.), Mechano Mill (Okada Seiko K. K.) and the like, with no significance in restricting the methods.

Colorants for toner used in the present invention are exemplified by carbon black, organic pigments or dyes such as phthalocyanine series, xanthene series.

If desired, charge controlling agents such as nigrosine dyes such as nigrosine base and the like, triphenylmethane dyes, polyamine resins and the like, fluidization agents such as silica, titanium oxide, vinylidene fluoride and the like; release agents such as polypropylene, polyethylene and the like; other known additives may be used.

EXAMPLES

This invention is explained by examples referring to appended Figures.

[Developing machine used in the examples]

As shown in FIG. 1, a developing device (1) adjoins a photoreceptor drum (100) driven rotatably in a direction as shown by an arrow (a).

The developing device (1) is composed of a rotatably roller (10) cylindrically formed; a cylindrical outer sleeve thin member with a peripheral length slightly longer than that of the driving roller (10) so as to be loosely mounted thereon; an elastic pad (9) which presses each end portion of the outer sleeve member (11) against the driving roller (10) so that a space (S) may be formed between the driving roller (10) and the outer sleeve thin member; a blade (12) pressed against the outersurface of the outer sleeve member (11); and a casing (3) supporting and restoring the members as above mentioned and toner (To).

The driving roller (10) is formed cylindrically and made of an electrically conductive material such as aluminum, stainless steel or the like, or may be formed such that an electrically conductive elastic member (such as nitrile rubber, silicon rubber, styrene rubber, butadiene rubber or the like) is mounted around the outersurface of a metallic roller. A developing bias voltage is applied to the driving roller (10).

The outer sleeve thin member (11) is formed cylindrically and has a peripheral length slightly longer than that of the driving roller (10) so as to be loosely mounted therearound. As the outer sleeve member (11) is used a soft resinous sheet, for example, of polycarbonate, nylon, fluorine resin or the like, a sheet of such resin including carbon or metallic fine particles or the like, a metallic thin film of nickel, stainless steel, aluminum or the like, or a laminated sheet of the resinous sheet and the metallic layer.

As the elastic guide pad (9) is used, for example, either of a material such as polyacetal, phenol resin, polyethylene, nylon, fluorine resin or the like, a member having a film of polyethylene, nylon, Teflon or the like on its contact surface with the outer sleeve thin member (11), or a foamed material having such film on its surface.

By the way, when a dynamic coefficient of friction between the external surface of the driving roller (10) and the internal surface of the outer sleeve member (11) is $\mu 1$ and that between the external surface of the outer sleeve member (11) and the guide pad (9) is $\mu 2$, $\mu 1$ and $\mu 2$ are selected to satisfy the relationship of $\mu 1 >> \mu 2$.

Accordingly, the driving roller (10) is caused to rotate in a direction as shown by an arrow (b), the outer sleeve thin member (11) rotates together with the rotation of the driving roller (10) without any slip between the two and the external surface of the outer sleeve thin member (11) covering the space S is continuously kept in contact through its suitable nip width with the external surface of the photoreceptor drum (100).

The blade (12) having at its forward end, a flexible sheet, for example, of Teflon, nylon or the like is securely mounted as a toner layer levelling member on the support member (6) provided above the driving roller (10). The blade (12) resiliently presses the driving roller (10) through the outer sleeve thin member (11). The blade (12) may be of a springly metallic thin plate of SK-steel, stainless steel, phosphor bronze or the like, an elastic plate of silicon rubber, urethane rubber or the like, a plate made of fluorine resin, nylone, or composite board thereof and the like, being different from toner in electrification rank.

Figure 2:
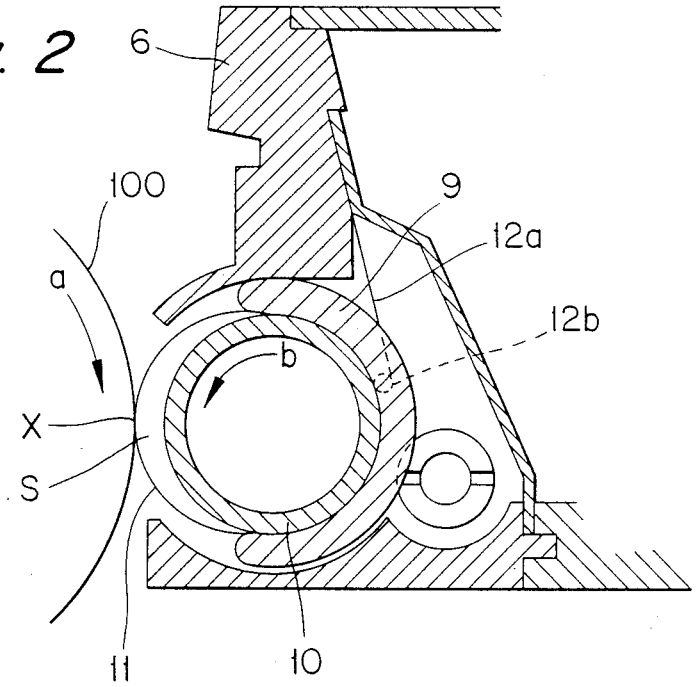
FIG. 2 is another cross-sectional view of a developing device.

As a toner levelling member, a metallic bar (12*b*) of rigid body contacted with the outer sleeve thin member (11) may be formed at the end of elastic plate member (12*a*) as shown in FIG. 2.

The rigid body is not strained and deformed when pressed against the outer sleeve thin member around the driving roller to form an uniform toner layer. The rigid body is exemplified by a metallic bar made of iron, stainless steel or the like. When the driving roller is elastic, the rigid body may be a molded part of synthetic resin such as polyethylene, polyacetal, Teflon and the like. The rigid body is contacted with the outer sleeve member to form a space having a curved surface therebetween. The preferable curvature radius of the curved surface depends on system speed of a machine, rotation torque of a developing machine, pressure of a toner levelling member, and the like, but being adjusted to 0.25–1.0 mm in general.

A toner levelling pad (16) is formed down the developing region (X). A casing (3) is composed of a toner storing compartment (15). The toner storing compartment (15) is internally provided with an agitator (14) disposed rotatably in a direction as shown by an arrow (C). The agitator (14) functions to agitate the Toner To stored in the toner storing compartment (15) in a direction as shown by the arrow (c) for prevention of blocking thereof or the like.

The operation of the developing device of the present invention will be explained hereinafter.

On condition that the driving roller (10) and the agitator (14) are caused to rotate by a driving source (not shown) respectively in directions as shown by the arrows (b) and (c), the toner To is forcibly moved in a direction shown by the arrow (c) under an effect of stirring by the agitator (14). The toner To accommodated within the toner storing compartment (15) is in contact with the outer sleeve member (11) and being transported in a direction of rotation of the outer sleeve member (11) by the action of electrostatic force. When the toner To is caught in a V-shaped taking-in portion formed between the outer sleeve member (11) and the forward portion of blade (12), and reaches a pressure portion between the outer sleeve member (11) and the blade (12), the toner To is spread uniformly in the form of a thin layer on the surface of the outer sleeve member (11) and charged positively or negatively through the friction therewith.

The end of the blade (12) is made of a material with frictional electrification rank adequate for charging toner to desired polarity and being pressed against the surface of the driving roller through the outer sleeve thin member (11).

If toner are poor in fluidity, they aggregate near the pressing area of the blade against the outer sleeve member, resulting in toner-fixing onto the pressing area. Consequently, as toner can not smoothly move through the pressing area, an uniform toner layer can not be formed on the toner support member even after passing through the pressing area.

The phenomenon above mentioned, in particular, can be seen remarkably, after repeated use and causes the deterioration in image quality such as the generation of irregularities of lines in copied images. To the contrary, as toner excellent in fluidity are good in slip properties against toner and/or the blade, they pass smoothly and systematically through the pressing area to form an uniform thin layer of charged toner for a long time.

When the toner To held on the outer sleeve member (11) under the influence of the electrostatic force, reaches a developing region X confronting the photoreceptor drum (100), the toner To is caused to adhere to an electrostatic latent image formed on the surface of the photoreceptor drum (100) to form a toner image in accordance with a voltage difference between a surface voltage of the photoreceptor drum (100) and the bias voltage applied to the outer sleeve member.

The toner To having passed the developing region X is successively transported, together with the outer sleeve member (11), in direction as shown by the arrow (b). When the toner To passed between the toner levelling pad (13) and the outer sleeve member (11), a image pattern from which the toner To has already been consumed in the developing region X is erased so that the uniformity of the toner layer may be obtained.

Consequently, the thin layer of the charged toner is uniformly formed again on the surface of the outer sleeve member (11) at the pressure portion of the blade (12), and the aforementioned operation is repeated thereafter.

Figure 3:
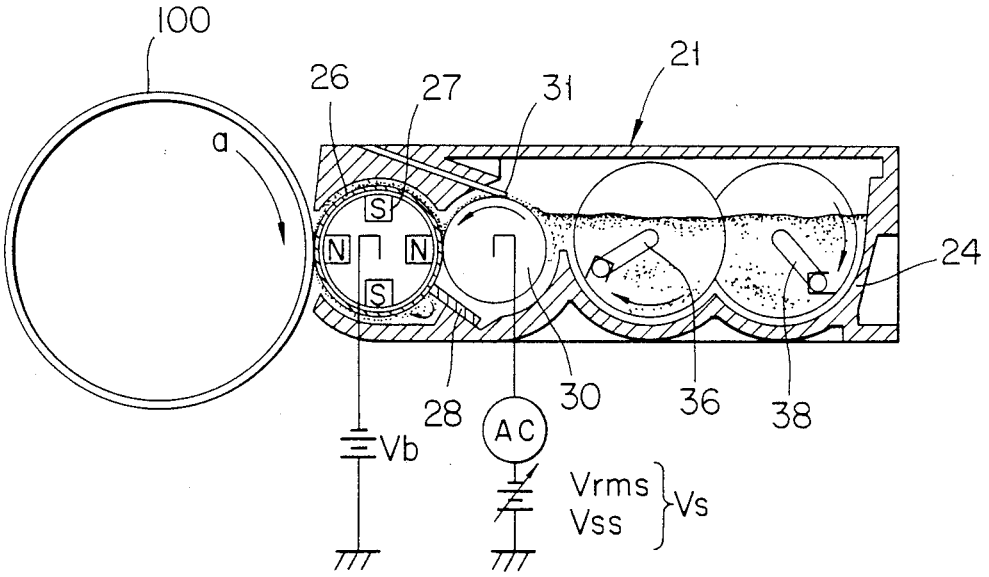
FIG. 3 is another cross-sectional view of a developing device.

The present invention may be also applied to a developing method of two components system as shown in FIG. 3 as well as a developing method of one component system as mainly aforementioned. The developing device (21) is provided with a photoreceptor drum (100) rotatably arranged in the direction of the arrow (a) and a casing (24). A developing sleeve (26) confronting the photoreceptor drum (100) is accomodated at the front portion of the casing (24). A developing sleeve (26) is cylindrical, made of non-magnetic and electrically conductive materials, with a developing bias voltage Vb being applied thereto and rotatably arranged with a driving source (not shown) in the direction of the arrow.

A magnetic roller (27) is installed fixedly inside the developing sleeve (26), and is internally provided with a plurality of magnets disposed along its peripheral portion each extending in parallel relationship with its central axis so that the N pole and the S pole may be arranged alternately. A brush bristle adjusting members (28) is mounted on the casing (24) at an oblique lower portion of the developing sleeve (26) and the forward end thereof confronts the sleeve in spaced relation by defining therebetween a predetermined brush bristle adjusting gap. A developer gathering portion is formed at the upper side in the rotation direction of the developing sleeve.

A toner providing roller (30) is arranged confronting the developing sleeve (26) in spaced relation by defining therebetween a predetermined providing gap at the rear side of the developing sleeve (26).

The toner providing roller (30) is composed of non-magnetic and electrically conductive material and rotatable arranged with a driving source (not shown) in the direction of the arrow. Fine hollows are formed on the peripheral portion of the toner providing roller (30) by a blast treatment or an etching treatment. The negative side of the direct current voltage (Vss) (the positive side of which is earthed) is applied to the toner providing roller (30) through the alternating current (Vrms) as the recovery bias voltage (Vs). In particular, the power output of direct current voltage (Vss) is variable.

The end of a toner levelling blade (31) fitted on the casing is pressed against the upper side of the peripheral portion of the toner providing roller (30).

At the rear portion of the casing (24) divided by the toner providing roller (30) and the toner levelling blade (31), a toner hopper is formed, and transport fins (36), (38) are arranged rotatably.

In the developing device (21) as above mentioned toner is stored in the toner hopper, and a starter containing toner and carriers at the specified ratio is stored on the developing sleeve and at the developer gathering portion. The starter composed only of carriers may be used.

The toner and carriers are contacted frictionally each other to be charged. The charged polarity of toner are opposite to that of carriers. In this examples, positively chargeable toner and negatively chargeable carriers are used.

[Examples of toner preparations]

(Toner A–C)

| ingredients | parts by weight |
|---|---|
| polyester resin (softening point; 130° C., glass transition temperature; 60° C.) | 100 |
| carbon black (MA#8: produced by Mitsubishi Kasei K.K.) | 5 |
| Viscol 550P (produced by Sanyo Kasei Kogyo K.K.) | 5 |
| Spilon Black TRH (Chromium complex dye) (produced by Hodoya Kagaku Kogyo K.K.) | 3 |

The above-mentioned ingredients were sufficiently mixed in a ball mills being kneaded over a three roller heated to 140° C. The kneaded mixture was left to stand for cooling, and coarsely pulverized in a feather mill. Then, the obtained particles were further pulverized into fine particles under jet stream, followed by being gir-classified to obtain an undefined shape Toner A of 10 μm in mean particle size. Toner size distribution of toner of at least 16 μm was 9%.

Toner B, Toner C, having undefined shapes, were obtained in a composition and a method similar to the preparation of Toner A except for pulverizing and classifying conditions.

| mean particle size | particle size distribution of toner with at least 16 μm (%) |
|---|---|
| Toner B 10 μm | 5 |
| Toner C 10 μm | 12 |

(Toner D)

| ingredients | parts by weight |
|---|---|
| styrene-n-butyl-methacrylate resin (softening point; 132° C. glass transition temperature; (60° C.) | 100 |
| carbon black (MA#8; produced by Mitsubishi Kasei Kogyo K.K.) | 5 |
| Nigrosin dye (Bontron N-01; produced by Orient Kagaku K. K.) | |

Toner D was prepared in a manner similar to the preparation of Toner A except for using the above mentioned ingredients. Toner D was 10 μm in mean particle size and the particle size distribution of toner of at least 16 μm was 8%.

(Toner E) (−) toner

| ingredients | parts by weight |
|---|---|
| styrene | 60 |
| n-butyl methacrylate | 35 |
| methacrylic acid | 5 |
| 2,2-azobis-(2,4-dimethylvaleronitrile) | 0.5 |
| polypropylene of low molecular weight oxidized type (Viscol TS-200; produced by Snayo Kasei Kogyo K.K.) | 3 |
| carbon black MA#8 (produced by Mitsubishi Kasei Kogyo K.K.) | 8 |
| Spilon Black TRH (chromium complex dye) (produced by Hodoya Kagaku Kogyo K.K.) | 5 |

The above ingredients were mixed sufficiently with the use of a sand-stirrer to prepare a polymerizable composition.

This polymerizable composition was mixed with an aqueous solution of arabic gum of a concentration of 3% by weight, and they were stirred at 3,000 rpm with the use of T. K. AUTO HOMO MIXER (manufactured by Tokushukika Kogyosha K. K.) to polymerize them at the temperature of 60° C. for 6 hours, and they were heated to 80° C. and further polymerized them at 1,200 rpm. After their polymerization, the system of reaction was cooled, rinsed five times, filtered, and dried, resulting in spherical particles.

The obtained spherical particle was 10 μm in the mean particle size, 141° C. in the softening point (Tm), and 61° C. in the glass transition point (Tg). The obtained spherical particles were classified to obtain spherical Toner E of 10 μm in mean particle size and the particle size distribution of toner of at least 16 μm was 1%.

(Toner F, G, H) (−)toner

Toner F, G and H were prepared in a composition and method similar to the preparation of Toner A except for pulverizing and classifying conditions.

| | mean particle size (μm) | particle size distribution of toner with at least 16 μm (%) | coefficient of variation k (%) |
|---|---|---|---|
| Toner F | 12 | 2 | 15 |
| Toner G | 15 | 35 | 15 |
| Toner H | 11 | 4 | 22 |

(Toner I, J, K) C−1 toner

Toner I, J and K were prepared in a composition and method similar to the preparation of Toner E except that the stirring rotation number at pulverization, and classifying conditions after the pulverization and drying are different.

| | mean particle size (μm) | particle size distribution of toner with at least 16 μm (%) | coefficient of variation k (%) |
|---|---|---|---|
| Toner I | 6 | 0 | 12 |
| Toner J | 10 | 3 | 19 |
| Toner K | 12 | 12 | 23 |

(Toner L)

| ingredients | parts by weight |
|---|---|
| styrene/n-butyl methacrylate resin | 85 |
| styrene/n-butyl methacrylate/ 2,2,2-trifluoroethyl acrylate = 70/15/15 (Tm = 135° C., Tg = 62° C.) | 15 |
| Viscol 550P (produced by Sanyo Kasei Kogyo K.K.) | 5 |
| carbon black MA#8 (produced by Mitsubishi Kasei Kogyo K.K.) | 8 |
| Spilon Black TRH (chromium complex type dye) (produced by Hodoya Kagaku Kogyo K.K.) | 3 |

Toner L was prepared in a manner similar to the preparation of Toner F except for using the above mentioned ingredients. Toner L was 12 μm in mean particle size, and the particle size distribution of toner of at least 16 μm was 3% and the coefficient of variation (k) was 16%.

(Toner M)

One hundred parts by weight of Toner E and 0.5 parts by weight of chromium complex type dye (Spilon Black TRH produced by Hodoya Kagaku Kogyo K. K.) were mixed and stirred at 1,500 rpm for 2 minutes with the use of an O. M. dizer of hybridization system NHS—1 type (manufactured by Nara Kikai Seisakusho K. K.), so that the particles of Spilon Black TRH were adhered to the particle surface of Toner E. Then, the resultant toner with Spilon Black TRH was further stirred at 9,000 rpm for 3 minutes with the use of the same hybridizer of hybridization system, so that the particles of Spilon Black TRH were fixed to the surface of Toner E to obtain Tomer M.

Toner M was 10 μm in mean particle size, the particle size distribution of toner of at least 16 μm was 1% and the coefficient variability of toner (k) was 14%.

(Toner N)

Four grams of styren (reagent of first grade; produced by Wako Junyaku Kogyo K. K.), 60 g of 2-ethylhexyl methacrylate (reagent of first grade; produced by Wako Junyaku Kogyo), 2 g of azobisisobutyronitrile (reagent of first grade produced by Wako Junyaku Kogyo K. K.) were dissolved in a mix solvent of 200 g of Isoper H (aliphatic hydrocarbon produced by shell Chemical K. K.) (80 g) with dichloromethane/acetone (1:1). Sixty grams of $CuFe_2O_4$—$CuMn_2O_4$ (produced by Dainichiseika K. K.) were mixed for dispersion into the above obtained solution by a vibration mill.

The particle size distribution of $CuFe_2O_4$—$CuMn_2O_4$ was measured by a measuring apparatus of particle size distribution of optical transmission type to obtain 0.05–1 μm, and the mean particle size was about 0.1–0.2 μm. The oil absorption was 35 cc/g. A solution of Takenate D-102 (isocyanate; produced by Takeda Yakuhin K. K.) of 10 g dissolved in ethyl acetate of 5 g was added to the resultant black ink of 150 g under cooling conditions to prepare a black ink-isocyanate solution. On the other hand, an aqueous 5% solution of arabic gum (produced by Wako Junyaku Kogyo K. K.) was prepared to be cooled sufficiently in ice water. The black ink-isocyanate solution was added into the aqueous solution, followed by stirring for 30 minutes at 6,000 rpm by AUTO HOMO MIXER to make the black ink fine particles. Then, 25 g of 10% solution of hexamethylenediamine (produced by Wako Junyaku Kogyo K. K.) was titrated and stirred for 10 minutes. The resultant solution was heated, then sitrred at 2,500 rpm for 2 hours, and further kept at 80°–90° C. for stirring for 6 hours.

After the reaction, a decantation and a pure-water washing process were repeated three times to remove unreacted materials, arabic gum and fine particles. The obtained dispersion was spray-dried. The resultant particles were heated and dried at 60° C. for 36 hours, followed by air-classification to obtain encapsulated Toner N with 12 μm in mean particle size. The particle size distribution of toner of at least 16 μm was 2% and the coefficient of variation was 13%.

(Toner O-R)

One hundred parts by weight mono-disperse spherical particles of styrene-n-butyl methacrylate polymer (an mean particle size of 8 μm, a softening point of 128° C., and a glass transition point of 54° C.) obtained through the seed polymerization, and 5 parts by weight of carbon black MA#8 (produced by Mitsubishi Kasei Kogyo K. K.) were put into Henshel Mixer of 10 liter volume. They were mixed and stirred at 1,500 rpm for 2 minutes to adhere carbon black around the surfaces of polymer particles. And then, the adhered carbon black were fixed around the surfaces of polymer particles with the use of a hybridizer of Hybridization system NHS—1 type (manufactured by Nara Kikai Seisakusho K. K.) at 9,000 rpm for 3 minutes.

One hundred parts by weight of the above carbon black-attached polymer particles, and 10 parts by weight of fine particles, and 10 parts by weight of fine particles of PMMA, MP-1451 (of a glass transition point of 125° C., 0.15 μm in mean particle size, produced by Soken Kagakusha K. K.) were mixed and stirred in a similar manner to that of the above process, so that the surfaces of the polymer particles were coated with the PMMA resin. Furthermore, one hundred parts by weight of the obtained PMMA-coated polymer particles, and 0.5 parts by weight of Spilon Black TRH (chromium complex type dye, produced by Hodoya Kagaku Kogyo K. K.) as a negative charge-controlling agent were mixed and stirred in a manner similar to that of the above process, so that the the particles of Spilon Black might be fixed to the surfaces of the polymer particles. Theus, Toner O of 8.3 μm in mean particles size was obtained. The particle size distribution of toner of at least 16 μm was 0% and the coefficient of variation was 7%.

Toner P-R were prepared in a manner similar to the preparation of Toner O except that the sizes of particles obtained by seed polymerization were varied.

| Toner | size of particle obtained by seed polymerization | mean particle size of toners (μm) | particle size distribution of toners with at least 16 μm (%) | coefficient of variation (%) |
|---|---|---|---|---|
| O | 8 | 8.3 | 0 | 7 |
| P | 2 | 2.2 | 0 | 9 |
| Q | 4 | 4.3 | 0 | 8 |
| R | 12 | 12.4 | 0 | 7 |

(Toner S)

Toner S was prepared in a manner similar to the preparation of Toner O except that Nigrosin dye (Bontron N-01; produced by Orient Kagaku Kogyo K. K.) was used instead of Spilon Black TRH. Toner S was 8.3 μm in mean particle size. The particle size distribution of toner of at least 16 μm was 0% and the coefficient of variation was 7%.

EXAMPLE 1

The copying machine (shown in FIG. 1) was provided with the above obtained toner for development under the conditions below;

Toner support member: Electrically conductive and cylindrical member having inside diameter 0.5 mm longer than outside diameter of the driving roller.

Photoreceptor drum: Organic photoconductor (OPC); its contact pressure with the toner support member was 0.2 g/mm. Its contact width with the toner support member was 2 mm.

Toner levelling member: As a leaf spring member was used a plate made of phosphor bronze of 0.1 mm in thickness; Silicon rubber of 50° in hardness was an integral part thereof at the end of the leaf spring.

4–5 g/mm

Developing conditions: Vo=−400 V, VB=−200 V. Inversion development

Toner layer conditions Q=−20∼−25 μC/g, M≃0.5 mg/cm$^2$

Provided Toner: (A), (B), (E)

Toner (A), (B) and (E) in which the content of toner of at least 16 μm in particle size was 9%, 5% and 1% respectively, were provided with the developing device. The developing device was installed in SP-130 Printer (85 mm/sec; produced by Minolta Camera K. K.) for durability test with respect to copy. The generation of fogs and the toner flying and scattering conditions around characters were observed. Toner (A), (B) and (E) could respectively form copied images without fogs and image disorders even after the copy process was repeated 10×10$^3$ times.

COMPARATIVE EXAMPLE (Toner (C) was used)

Toner (C), in which the content of toner of at least 16 μm in particle size was 12%, was subjected to a durability test similar to Example 1. Fogs generated and the copied conditions around characters were much deteriorated.

EXAMPLE 2

(Toner (F), (I) and (J) were applied)

Toner (F), (I) and (J), in which the content of toner of at least 16 μm in particle size was 10% or less respectively and the coefficient of variation (one barometer of toner distribution) was 15%, 12% and 19% respectively, were evaluated respectively in a manner similar to Example 1. Although the resolving power was a little different caused by the mean particle size of each Toner, the copied image quality was not changed practically in the durability test. Clear images without fogs and image disorders were formed even after the copying process of 10×10$^3$ times.

COMPARATIVE EXAMPLE 2

(Toner (G), (H) and (K) were applied)

Toner (G), (H) and (K) having relatively sharp distribution as shown below were evaluated respectively in a manner similar to Example 1.

| Toner | mean particle size | particle size distribution of toner with at least 16 μm | coefficient of variation |
|---|---|---|---|
| G | 15 μm | 35% | 15% |
| H | 11 μm | 4% | 22% |
| K | 12 μm | 12% | 23% |

In the case of Toner (H), image qualities were changed with time, because there arose particle size selecting phenomenon during the durability test being caused by the broad distribution of toner. In the case of Toner K, the generation of fogs and much deterioration of copied conditions around characters were observed during the durability test as well as the copied image quality change. In the case of Toner (G), the generation of fogs and much deterioration of copied conditions around characters were observed.

EXAMPLE 3

(Toner (O), (P), (Q) and (R) were applied)

Toner (O), (P), (Q) and (R) having relatively sharp distribution as shown below were provided with the developing device.

| Toner | mean particle size | particle size distribution of toner with at least 16 μm | coefficient of variation |
|---|---|---|---|
| O | 8.3 μm | 0% | 7% |
| P | 2.2 μm | 0% | 9% |
| Q | 4.3 μm | 0% | 8% |
| R | 12.4 μm | 0% | 7% |

The developing device was installed in the printer (150 mm/sec; produced by Minolta Camera K. K.) for evaluation in a manner similar to Example 1. Although the resolving power was a little different caused by the mean particle size of each Toner, no changes in image quality were observed during the durability test with respect to copy. The mean particle sizes of each Toner after the copying process of 10×10$^3$ times was as same as those of original Toner. Further, as spherical toner were used, the thin layer formed on the toner support layer was very uniform to obtain clear images with surface texture during the durability test with respect to copy.

EXAMPLE 4

Toner O, Toner P, Toner Q and Toner R were subjected to a durability test with respect to copy in a manner similar to Example 1 using the same copying machine except for the conditions shown below;

Toner levelling member: cylindrical

Metallic member (1.5 mmϕ), 5-6 g/mm

Toner layer conditions:

$Q = -15 \sim -20\ \mu C/g$ $M = 0.5\text{-}0.6\ mg/cm^2$

The obtained resulted were as same as those of Example 3.

EXAMPLE 5

(Toner (M) and (L) were applied)

Toner (M) with charge controlling agent adhered onto the surface, Toner (L) comprising a resin with polar groups were evaluated in a manner similar to Example 3. Both of Toner (M) and (L) were improved in chargeability. The copied image quality was not changed practically during the durability test. Clean images without fogs and image disorders were formed.

EXAMPLE 6

(Toner D was applied)

Developing conditions; $Vo = -500$ V, $VB = -200$ V, normal development (not inversion development)

Toner layer conditions:

$Q = \sim +20\ \mu C/g\ M = \sim 0.5\ mg/cm^2$

Toner D, which had 8% of the particle size distribution of toner with at least 16 μm, was provided with the developing device. The developing device was installed in P.P.C. (EP-50: 85 mm/sec; produced by Minolta Camera K.K.) for durability test with respect to copy. The generation of fogs and the toner flying and scattering conditions around characters were observed. Toner (D) could form copied images without fogs and image disorders even after the copying process was repeated $10 \times 10^3$ times.

EXAMPLE 7

(Toner (N) and (S) were applied)

Toner (N) and (S) as shown below were provided with the developing device. The developing device was installed in P.P.C. (EP-470; 180 mm/sec; produced by Minolta Camera K.K.) for the evaluation in a manner similar to Example 6.

| Toner | Particle size distribution of toner with at least 16 μm | coefficient of variation |
|---|---|---|
| N | 2% | 13% |
| S | 0% | 7% |

Each of Toner (N) and (S) did not influenced the practical copied image quality in the durability test. Further, an uniform thin layer of toner effected the formation of clear copied images with fine surface texture.

By the way, encapsulated Toner (N) was fixed by pressure (surface pressure; 150 kg/cm²)

The evaluations of Examples 1-7 (Toner A - S) were summarized in Table 1.

In the evaluation of fogs and toner-flying conditions after $10 \times 10^3$ times of durability test with respect to copy, the symbol "o" means that fogs and toner flying around characters were not observed practically; the symbol "X" means that fogs and toner flying around characters were observed.

In the evaluation of changes of image quality after $10 \times 10^3$ times of durability test with respect to copy, the symbol "O" means that copied image quality after the durability test was as same as that of the initial stage; the symbol "O" means that copied image quality after the durability test was almost as same as that of the initial stage; the symbol "X" means that copied images were more disordered than those of initial stage.

TABLE 1

| Toner | mean particle size (μm) | more than 16% in particle size (%) | coefficient of variation k (%) | shape | polarity | valuation: fogs and toner-flying conditions around characters | valuation: change of image quality |
|---|---|---|---|---|---|---|---|
| A | 10 | 9 | 18 | non-specified | − | | |
| B | 10 | 5 | 17 | non-specified | − | | |
| C | 10 | 12 | 24 | non-specified | − | X | X |
| D | 10 | 8 | 19 | non-specified | − | | |
| E | 10 | 1 | 13 | spherical (suspension) | − | | |
| F | 12 | 2 | 15 | non-specified | − | | |
| G | 15 | 35 | 15 | non-specified | − | X | X |
| H | 11 | 4 | 22 | non-specified | − | X | X |
| I | 6 | 0 | 12 | spherical (suspension) | − | | |
| J | 10 | 3 | 19 | spherical (suspension) | − | | |
| K | 12 | 12 | 23 | spherical (suspension) | − | X | X |
| L | 12 | 3 | 16 | non-specified | − | | |
| M | 10 | 1 | 14 | spherical (suspension) | − | | |
| N | 12 | 2 | 13 | spherical (nicro) | + | | |
| O | 8.3 | 0 | 7 | spherical | − | | |
| P | 2.2 | 0 | 9 | spherical | − | | |
| Q | 4.3 | 0 | 8 | spherical | − | | |
| R | 12.0 | 0 | 7 | spherical | − | | |
| S | 8.3 | 0 | 7 | spherical | + | | |

What is claimed is:

1. A method for developing an electrostatic latent image comprising the steps of;

(a) supplying toner onto a toner transporting member which confronts an electrostatic latent image support member with the electrostatic latent image thereon at a developing region, said toner being 12

μm or less in mean particle size, 10% or less of toner having at least 16 μm in particle size, and 20% or less in coefficient of variation, said coefficient of variation being defined as:

$$\text{Coefficient of variation } (\%) = (\rho/X) \times 100$$

wherein a standard deviation value (ρ) is represented by a following formula:

$$\sigma = \sqrt{\frac{(X_1 - X)^2 + (X_2 - X)^2 + (Xn - X)^2}{N - 1}} \approx \sqrt{\frac{1}{n-1}\left[\Sigma Xi^2 - \frac{(\Sigma Xi)^2}{n}\right]}$$

wherein $X_1$, $X_2$,... Xn represent respective particle sizes of sample particles, and X represents a mean value of n particle sizes;

(b) forming a thin layer of said toner on the toner transporting member by pressing said toner; and (c) transferring said toner from said thin layer of said toner onto the electrostatic latent image formed on said electrostatic latent image support member for developing the electrostatic latent image.

2. A developing method of claim 1, wherein said toner transporting member confronts the electrostatic latent image support member with the electrostatic latent image thereon at an developing region.

3. A developing method of claim 2, wherein said thin layer of toner in step (c) is in contact with the electrostatic latent image support member at the developing region.

4. A developing method of claim 1, wherein said toner transporting member confronts a magnetic developing member which comprises a cylindrical developing sleeve and a magnetic roller installed inside the developing sleeve.

5. A developing method of claim 1, wherein said pressing of toner in step (b) is performed by use of a toner levelling member.

6. A developing method of claim 5, wherein the toner levelling member comprises elastic member.

7. A developing method of claim 5, wherein the toner levelling member comprising a crook portion, the curved surface of which is pressed against the toner transporting member, and a supporting portion of the crook portion.

8. A method for developing an electrostatic latent image comprising the steps of;

(a) supplying toner onto a toner transporting member which includes a driving roller with a cylindrical thin outer sleeve member having a peripheral length longer than that of the driving roller and disposed to confront with an electrostatic latent image support member carrying the electrostatic latent image thereon at a developing region, said toner being 12 μm or less in mean particle size, 10% or less of toner having at least 16 μm in particle size, and 20% or less in coefficient of variation, said coefficient of variation being defined as:

$$\text{Coefficient of variation } (\%) = (\rho/X) \times 100$$

wherein a standard deviation value (ρ) is represented by a following formula:

$$\sigma = \sqrt{\frac{(X_1 - X)^2 + (X_2 - X)^2 + (Xn - X)^2}{N - 1}} \approx \sqrt{\frac{1}{n-1}\left[\Sigma Xi^2 - \frac{(\Sigma Xi)^2}{n}\right]}$$

wherein $X_1$, $X_2$, Xn represent respective particle sizes of sample particles, and X represents a mean value of n particle sizes;

(b) forming a thin layer of said toner on the toner transporting member by pressing said toner; and (c) transferring said toner from said thin layer of said toner onto the electrostatic latent image formed on said electrostatic latent image support member for developing the electrostatic latent image.

9. A developing method of claim 8, wherein said thin layer of toner in step (c) is in contact with the electrostatic latent image support member at the developing region.

10. A developing method of claim 8, wherein said pressing of toner in step (b) is performed by use of a toner levelling member.

11. A developing method of claim 10, wherein the toner levelling member comprises elastic member.

12. A developing method of claim 10, wherein the toner levelling member comprising a crook portion, the curved surface of which is pressed against the toner transporting member, and a supporting portion of the crook portion.

13. A developing method of claim 8, wherein a part of the outer sleeve member is in contact with the driving roller to form a loosely mounted portion of the outer sleeve member.

14. A developing method of claim 13, wherein the loosely mounted portion of the outer sleeve member confronts the electrostatic latent image support member.

15. A developing method of claim 13, wherein μ1 and μ2 satisfy the relationship of μ1>>μ2, in which μ1 is a dynamic coefficient of friction between the external surface of the driving roller and the internal surface of the outer sleeve member, and μ2 is a dynamic coefficient of friction between the external surface of the outer sleeve member and a means which forms the loosely mounted portion of the outer sleeve region.

16. A developing method of claim 1, wherein said toner has spherical shape.

17. A developing method of claim 8, wherein said toner has spherical shape.

18. A developing method of claim 1, wherein said toner has 10% or less in coefficient of variation.

19. A developing method of claim 8, wherein said toner has 10% or less in coefficient of variation.

* * * * *